US006280658B1

(12) United States Patent
Atarashi et al.

(10) Patent No.: US 6,280,658 B1
(45) Date of Patent: Aug. 28, 2001

(54) RHEOLOGICAL FLUID

(75) Inventors: Takafumi Atarashi, Tokyo; Katsuto Nakatsuka, Miyagi, both of (JP)

(73) Assignees: Nittesu Mining Co., Ltd., Tokyo; Katsuto Natatsuka, Miyagi, both of (JP)

( * ) Notice: Subject to any disclaimer, the term of this patent is extended or adjusted under 35 U.S.C. 154(b) by 0 days.

(21) Appl. No.: 09/242,662

(22) PCT Filed: Aug. 20, 1997

(86) PCT No.: PCT/JP97/02893

§ 371 Date: Feb. 22, 1999

§ 102(e) Date: Feb. 22, 1999

(87) PCT Pub. No.: WO98/08235

PCT Pub. Date: Feb. 26, 1998

(30) Foreign Application Priority Data

Aug. 23, 1996 (JP) ..... 8-222780

(51) Int. Cl.[7] ..... H01B 3/20

(52) U.S. Cl. ..... 252/572; 252/74; 252/75; 252/62.52

(58) Field of Search ..... 252/572, 74, 75, 252/62.52

(56) References Cited

U.S. PATENT DOCUMENTS 4,705,356 * 11/1987 Berning et al. ..... 350/166
5,135,812 * 8/1992 Phillips et al. ..... 428/403
5,271,858 * 12/1993 Clough et al. ..... 252/74
5,507,967 * 4/1996 Fujita et al. ..... 252/74
5,516,445 * 5/1996 Sasaki et al. ..... 252/62.56
5,607,617 * 3/1997 Inoue et al. ..... 252/73
5,702,630 * 12/1997 Sasaki et al. ..... 252/62.52
5,736,064 * 4/1998 Edamura et al. ..... 252/74

FOREIGN PATENT DOCUMENTS 0 609 897 A2 8/1994 (EP) .
61-105509 5/1986 (JP) ..... G02B/5/28
62-260875 11/1987 (JP) ..... C09D/11/00
1-260710 10/1989 (JP) ..... H01B/1/20
7-90290 1/1995 (JP) ..... C10M/169/04
7-226316 8/1995 (JP) ..... H01F/1/44
8-165448 6/1996 (JP) ..... C09D/11/02
9-111167 4/1997 (JP) ..... C09D/11/00
9-208788 8/1997 (JP) ..... C08L/33/04
93/19143 * 9/1993 (WO) .

* cited by examiner

*Primary Examiner*—Yogendra N. Gupta
*Assistant Examiner*—Derrick G. Hamlin
(74) *Attorney, Agent, or Firm*—Sughrue, Mion, Zinn, Macpeak & Seas, PLLC

(57) ABSTRACT

A rheological fluid of a bright color which has excellent light resistance and weather resistance, is stable even when used in a high-temperature environment, can be stored over long, and mightily and precisely actuates in response to an electric field or a magnetic field or to both. The rheological fluid comprises a medium in which a film-coated powder comprising a base particle having thereon a coating layer(s) is dispersed.

12 Claims, 2 Drawing Sheets

RHEOLOGICAL FLUID

DESCRIPTION

1. Technical Field

The present invention relates to an electrorheological fluid (ERF), a magnetorheological fluid (MRF), and an electromagnetorheological fluid (EMRF). More particularly, the present invention relates to a rheological fluid which contains particles capable of being quickly and reversibly actuated by the application of an electric field or a magnetic field thereto, and which, by means of an applied electric field or magnetic field, can be quickly and reversibly changed in flowability, viscosity, and the like, and changed into even a gel state showing no flowability. When the powder dispersed in the fluid has optical properties, the rheological fluid is expected to be used in various applications. By utilizing a multilayer-coated powder of a bright color, the rheological fluid can be used as a color ink especially for ink-jet printers, a liquid color toner, or a color display medium.

2. Background Art

A rheological fluid is a functional fluid which usually is in a liquid state and flowable but which, upon application of an electric field or magnetic field or both, undergoes a marked increase in viscosity and changes into even a gel state showing no flowability.

Proposed so far as electrorheological fluids are a certain kind of polymer solution and suspensions of various particles. However, the former fluid does not sufficiently perform functions of an electrorheological fluid because the viscosity increase thereof with increasing applied voltage is small. Investigations have hence been made mainly on the latter fluids of the particle dispersion type. This is because ERFs of the particles dispersion type show a relatively satisfactory viscosity increase with increasing applied voltage (Winslow effect) as compared with the polymer solution type.

Incidentally, the particulate materials which have been known as particles to be dispersed into oily media to prepare electrorheological fluids include various substances such as silica, ion-exchange resins, barium titanate, hydrous phenolic resins, and crystalline zeolites. Among such particulate materials, inorganic substances have a high ERF effect, while polymer particles have satisfactory dispersibility. Because of this, it has been proposed to deposit fine particles of an inorganic substance on the surface of polymer particles to form an inorganic/organic composite two-layer structure to thereby give a powder for use in an electrorheological fluid (Gekkan Tribology, p. 24 (August 1994)).

Among fluids which actuate in response to a magnetic field are magnetic fluids. Ultrafine particles of a magnetic material which have particle diameters of 0.006 to 0.015 $\mu$m are used in magnetic fluids so as to keep the dispersed particles in a colloidal state. However, the concentration of magnetic-material particles in a magnetic fluid is about 35% at the most because a layer of a surfactant is formed on the surface of the ultrafine particles. In addition, since these magnetic-material particles are small, the intensity of magnetic properties (magnetization) thereof is as low as from 70 to 80% of that of large particles. Consequently, when such ultrafine particles are used to prepare a rheological fluid, the actuating force exerted by this fluid is so weak that a desired actuating force is not obtained or an exceedingly intense magnetic field is necessary.

On the other hand, a solvent colored with a dye has conventionally been used as a color ink for ink-jet printers.

However, when an ink prepared by coloring a solvent with a dye is used as a color ink for ink-jet printers, the prints obtained have a drawback that they cannot be preserved over long due to the poor light resistance and poor weather resistance of the ink.

Consequently, an object of the present invention is to eliminate such drawbacks and provide a rheological fluid which mightily and precisely actuates in response to an electric field or a magnetic field or both, and to provide a rheological fluid of a bright color which actuates in response to an electric field or a magnetic field or both.

Another object of the present invention is to provide a rheological fluid whose actuation in an electric field can be easily confirmed.

Still another object of the present invention is to provide a rheological fluid which, when used in ink-jet color recording, can give recorded images having excellent storage ability.

DISCLOSURE OF THE INVENTION

The present invention made intensive studies. As a result, it has been found that the above objects can be accomplished by forming one or more coating layers on the surface of base particles made of an insulating material, dielectric, or conductive material to produce a film-coated powder or multilayer-coated powder and dispersing the coated powder into a medium to obtain a rheological fluid. The present invention has thus been completed.

Specifically, the present invention can accomplish the above objects by the following means.

(1) A rheological fluid comprising a medium in which a film-coated powder comprising a base particle having thereon a coating layer(s) is dispersed.

(2) The rheological fluid according to (1), wherein the powder is a multilayer-coated powder having thereon coating layers which differ from each other in refractive index.

(3) The rheological fluid according to (1), which has an average particle diameter of 0.015 to 100 $\mu$m.

(4) The rheological fluid according to (1), wherein the base particles of the powder is selected from a conductive material, a dielectric material, an insulating material, and a magnetic material.

(5) The rheological fluid according to (2), wherein the multilayer-coated powder has a color attributable to interference.

(6) The rheological fluid according to (1), wherein at least one of the coating layers is an inorganic metal compound layer.

(7) The rheological fluid according to (1), wherein at least one of the coating layers is a metal layer or an alloy layer.

(8) The rheological fluid according to (1), wherein at least one of the coating layers is an organic layer.

(9) The rheological fluid according to (1), wherein the surface of the multilayer-coated powder has been treated beforehand so as to have an affinity for solvents.

(10) The rheological fluid according to (1), wherein the medium has been color with a colorant.

The film-coated powder (which means a powder having at least one coating layer) or multilayer-coated powder for use in the present invention is a powder which is produced by forming plural films having different refractive indexes on the surface of a base particles made of an insulating material, dielectric material, or conductive material so that the coated powder has a color due to multiple interference between the films.

The material of the particle constituting the core (base particle) may be any of an insulating material, a dielectric material, and a conductive material. In the case of an insulating material, it is preferred to use a resin powder especially because it is less apt to sediment due to its small specific gravity. Examples of the resin powder include powders consisting of spherical or crushed particles of an acrylic polymer, a styrene polymer, a copolymer, a vinyl polymer, and the like. An especially preferred resin powder is an acrylic resin powder consisting of spherical particles obtained by the polymerization of an acrylic or methacrylic ester.

In the case of a dielectric material, examples thereof include those having a high permittivity, such as oxides of titanium, barium, lead, lithium, chromium, aluminum, silicon, and magnesium and composite oxides of these metals, such as barium titanate, lead titanate, and the like, and further include clays and glasses.

Preferred examples of the base particles made of a conductive material include metals such as iron, nickel, chromium, titanium, aluminum, cobalt, and the like; metal alloys, such as iron-cobalt, iron nickel, and the like; metal nitrides, such as iron-nickel-cobalt nitride and the like; and metal carbides, such as iron carbide and the like.

In the case of a magnetic material, preferred examples thereof include metals, such as iron, nickel, chronium, titanium, aluminum, cobalt, and the like; magnetic metal alloys, such as iron-cobalt, iron-nickel, and the like; metal nitrides, such as iron-nickel-cobalt nitride and the like; metal carbides, such as iron carbide and the like; oxides, such as magnetite, γ-hematite, nickel oxide, and the like; and composite metal oxides, such as manganese ferrite, cobalt ferrite, and the like, although some of these have been already mentioned with regard to the above substances.

The plural coating layers formed on the surface of the base particle differ from each other in refractive index or in refractive index and permittivity. The materials thereof are desirably selected from inorganic metal compounds, metals, alloys, and organic substances.

Typical examples of the inorganic metal compounds which may constitute the coating layers include metal oxides. Specific examples thereof include oxides of iron, tin, nickel, chromium, titanium, aluminum, silicon, calcium, magnesium, barium, lead, strontium, and the like; and composite oxides, such as barium titanate, lead titanate, strontium titanate, and the like. Examples of the metal compounds other than metal oxides include metal nitrides, such as iron nitride, metal carbides, and the like.

Examples of the elemental metals which may constitute the coating layers include silver metal, cobalt metal, nickel metal, iron metal, indium metal, and palladium metal. Examples of the metal alloys include iron-nickel alloys, iron-cobalt alloys, iron-nickel alloy nitrides, and iron-nickel-cobalt alloy nitrides.

The organic substance which may constitute the coating layers are not particularly limited. However, resins are preferred. Examples of the resins include cellulose powders, cellulose acetate powders, polyamides, epoxy resins, polyesters, melamine resins, polyurethanes, vinyl acetate resins, silicone resins, and polymers or copolymers of acrylic esters, methacrylic esters, styrene, ethylene, propylene, and derivatives of these.

In the case of oxides, examples thereof include oxides of titanium, barium, lead, lithium, chromium, aluminum, silicon, and magnesium and composite oxides of these metals, such as barium titanate, lead titanate, and the like.

Although various materials can be used to constitute the coating layers as described above, a suitable combination materials is determined so as to obtain a desired interference color while taking account of the refractive index of each coating layer.

The base particle constituting the core may have any shape. Although a particle of irregular shapes, such as pulverized particles and the like, can be coated and colored, a spherical particle is especially preferred.

The particle diameter of the multilayer-coated powder for use in the present invention is not particularly limited, and can be suitably regulated according to purposes of the use of the fluid. However, the particle diameter thereof is usually 0.015 to 300 μm, preferably 0.02 to 100 μm.

In the plural coating layers, each constituent unit coating layer has a thickness of 0.015 to 30 μm, preferably 0.02 to 20 μm. When the powder particle is colored so as to produce a multifunctional powder having a color, the unit coating layers are preferably ones whose thicknesses have been determined so that these layers have interference reflection peaks or interference transmission bottoms at the same specific wavelength. More preferably, the thickness of each unit coating layer is determined by fixing the basic film thickness thereof which satisfies the following equation (1):

$$n_f \times d = m \times \lambda / 4 \quad (1)$$

wherein n represents a complex refractive index; d represents a basic film thickness; m represents an integer (natural number); λ represents a wavelength at which the interference reflection peak or interference transmission peak appears; and $n_f$ is defined by the following equation (2):

$$n_f = n + i\kappa \quad (2)$$

(wherein n represents a refractive index of each unit coating layer; i represents a complex number; and κ represents an extinction coefficient), and correcting the actual thicknesses of the unit coating layers based on the functions consisting of the phase shift caused by the extinction coefficient κ of refractive index, the phase shift occurring at film interfaces, and the peak shift attributable to refractive index dispersion and particle shape so that the unit coating layers have interference reflection peaks or interference transmission bottoms at the same specific wavelength as shown above.

A method of forming a multilayered film composed of layers of a metal oxide having a high refractive index and, alternately arranged therewith, layers of a metal oxide having a low refractive index is explained below in detail as an example. First, a powder is dispersed into an alcohol solution of an alkoxide of titanium, zirconium, or the like. A mixed solution consisting of water, an alcohol, and a catalyst is added dropwise to the dispersion with stirring to hydrolyze the alkoxide to thereby form on the surface of the powder particles a film of titanium oxide or zirconium oxide as a high-refractive-index film.

Thereafter, this powder is taken out by solid/liquid separation, dried, and then subjected to a heat treatment. The drying may be conducted by any means selected from vacuum drying with heating, vacuum drying, and natural drying. It is also possible to use an apparatus such as a spray dryer in an inert atmosphere while regulating the atmosphere. The heat treatment may be accomplished by heating the powder at 300 to 600° C. for from 1 minute to 3 hours either in air when the powder is unsusceptible to oxidation or in an inert atmosphere when the powder is susceptible to oxidation.

Subsequently, the particles having the high-refractive-index film formed thereon are dispersed into an alcohol solution of a metal alkoxide which gives an oxide having a low refractive index, such as a silicon alkoxide, aluminum alkoxide, or the like. A mixed solution consisting of water, an alcohol, and a catalyst is added dropwise to the resultant dispersion with stirring to hydrolyze the alkoxide to thereby form on the surface of the powder particles a film of silicon oxide or aluminum oxide as a low-refractive-index film.

Thereafter, the powder is taken out by solid/liquid separation, vacuum-dried, and then heat-treated in the same manner as the above. As a result of the above procedure, a powder is obtained in which the powder particles each has, on the surface thereof, two layers composed of a high-refractive-index meal oxide film and a low-refractive-index metal oxide film. Furthermore, the above procedure for forming metal oxide films is repeated to thereby obtain a powder in which each particle has multiple metal oxide films on its surface. Since the powder thus obtained has high-refractive-index metal oxide films alternately arranged with low-refractive-index metal oxide films as stated hereinabove, it is a powder having a high reflectance and a high whiteness or a powder which has a bright color due to interference or because it has reflection peaks or transmission bottoms in the visible wavelength region.

For forming a metal film on base particles or on a metal oxide film, use may be made of contact electroplating, sputtering, or a mechanochemical reaction in a grinding machine, besides the electroless plating described above. However, the contact electroplating as a drawback that powder particles not in contact with an electrode are not plated, while the sputtering has a drawback that a metal vapor is not evenly applied to the powder particles. Furthermore, the mechanochemical method may cause film peeling. Namely, the thickness of the coating formed by any of these methods varies from particle to particle. In contrast, the method of film formation by electroless plating is preferred in that a dense and even film can be formed and the film thickness is easy to regulate. The metal film is preferably heated after film formation in the same manner as for the metal oxide films.

The multilayer-coated powder for use in the present invention will be explained below in more detail.

The term "film-coated powder" as used herein means a powder comprising a base particle having thereon one or more coating layers.

When the coated powder has a single film, the powder particles obtained by coating the surface of base particles with a film having a difference permittivity or conductivity generally show larger polarization in an electric field than the base particles having no coating film. Consequently, when a base particle/film material combination, a film thickness, and the like are suitably selected, the coated particles show enhanced electrorheological properties. This is because the base particles of the film-coated powder each functions as a capacitor.

When the base particles are a magnetic material, the coated powder can be utilized not only as an electrorheological fluid, which actuates in response to an electric field, but as a magnetorheological fluid. This coated powder is also usable as a magnetoelectrorheological fluid when an electric field and a magnetic field are applied thereto simultaneously or alternately. By controlling the intensities of the applied electric field and magnetic field, the fluid viscosity can be precisely controlled or the fluid can be mightily actuated, whereby desired effective control is attained.

There are cases where rheological fluids are used in environments having temperatures of 100 to 500° C. However, if a rheological fluid for use in such environments is prepared from mere metal particles, the rheological fluid shows a reduced rheological effect because the metal particles are oxidized. This can be avoided by using an oxide film having an appropriate permittivity; the oxide film inhibits oxidation and prevents the rheological fluid from suffering a decrease in its effect.

When the coating film is formed by two or more difference films, electrorheological properties are enhanced when a combination of base particles with film materials, film thickness, and the like are suitable selected. In particular, in the multilayer-coated powder, each particle, which functions as a capacitor as stated hereinabove, can be a capacitor having a large capacitance when a suitable base particle/film material combination is selected so that, for example, base particles made of a conductive material are used and coated with two or more films including a dielectric or insulating material as the first film. Thus, this multilayer-coated powder produces a far higher dielectric polarization effect in an electric field than the base particles. In this case, when the base particles are made of a ferromagnetic material such as a metal or alloy, a magnetoelectrorheological fluid producing a high electrorheological effect and a high magnetorheological effect can be obtained. When the particles can be colored, the rheological fluid is usable in a wider range of applications.

FIG. 1 is a sectional view diagrammatically illustrating the structure of a particle of the multilayer-coated powder. This coated particle comprises a particle 1 as a core and, formed thereon, coating layers 2 and coating layers 3 differing in refractive index from the layers 2. A special function can be imparted thereto by regulating the thicknesses of the coating films differing in refractive index alternately formed on the surface of each particle.

For example, coating films differing in refractive index are alternately formed on each powder particle so as to satisfy the following equation (1). Namely, films which each is made of a substance having a refractive index n and has a thickness d corresponding to m (integer) times the value which is one-fourth a wavelength of visible light are formed in an appropriate thickness and number. As a result, the light having a specific wavelength λ (the light utilizing Fresnel's interference reflection) is reflected or absorbed.

$$nd=m\lambda/4 \quad (1)$$

This function is utilized as follows. An oxide film having such a thickness and refractive index as to satisfy equation (1) with respect to a target wavelength of visible light is formed on the surface of each powder particle, and this film is coated with an oxide film having a difference refractive index. This procedure is conducted once or repeated one or more times to thereby form films which have a characteristic reflection or absorption wavelength width in the visible light region. In the above procedure, the sequence of material deposition for film formation is determined in the following manner. When the powder particles serving as cores have a high refractive index, a film having a low refractive index is preferably formed as the first layer. In the reverse case, a film having a high refractive index is preferably formed as the first layer.

Film thickness is controlled based on a measurement is which the change of optical film thickness, which is the product of the refractive index of the film and the film thickness, is determined as reflection waveform with a spectrophotometer or the like. The thickness of each layer is designed so that the reflection waveform conforms to the finally required waveform. For example, when the unit coating films constituting a multilayered film have reflection waveform peaks at different positions, the powder is white. On the other hand, when the unit coating films are regulated so that the reflection waveform peaks thereof are in exactly the same position, a monochromatic colored powder, e.g., a blue, green, or yellow powder, can be obtained without using a dye or pigment.

However, in the case of an actual powder, a design should be made while taking account of the particle diameter and shape of the powder, the phase shift occurring at interfaces between film materials and the base particle material, the peak shift attributable to the wavelength dependence of refractive index, and the like. For example, when the base particles have a plane parallel plate shape, the Fresnel interference caused by parallel films formed on a plane surface of the particle is designed under the conditions including the above equation (1) in which n has been replaced with $n_f$ defined by the following equation (2). In particular, when a metal film is contained, extinction coefficient κ is included in the refractive index $n_f$ of the metal defined by equation (2) even though the particle shape is a plane parallel plate shape. In the case of transparent oxides (dielectrics), κ is exceedingly small and negligible.

$n_f=n+i\kappa$ (i represents a complex number) (2) When the extinction coefficient κ is large, an enhanced phase shift occurs at the interface between the film material and the base particle material, and this phase shift influences the optimum interference thicknesses of all layers of the multilayered film.

Because of the above, the mere regulation of geometrical film thicknesses results in difference peak positions, and, hence, in a lighter color especially in monochromatic coloring. In order to avoid this, a design is made beforehand through a computer simulation so as to result in an optimal combination of film thicknesses while taking account of influences of the phase shift on all films.

There also are the phase shift caused by an oxide layer present on a metal surface and the peak shift attributable to the wavelength dependence of refractive index. In order to correct these, it is necessary to use a spectrophotometer or the like to find optimal conditions under which reflection peaks or absorption bottoms appear at target wavelengths in a final target number of films.

In a film formed on a curved surface such as that of a spherical particle, interference occurs similarly to that on plane plates and is basically in accordance with Fresnel's interference principle. Consequently, a coloring method can be designed so as to produce a white powder and a monochromatic powder. However, in the case of curved surfaces, the light which has struck on the powder and has been reflected causes complicated interference. The resultant interference waveforms are almost the same as on plane plates when the number of films is small. However, as the total number of films increases, the interference within the multilayered film becomes more complicated. In the case of a multilayered film also, a spectral reflection curve can be designed beforehand based on Fresnel interference through a computer simulation so as to result in an optimal combination of film thicknesses.

In particular, when coating films are formed on the surface of powder particles, the influences of a phase shift on the powder particles surface and on all films are taken in account when a design is made beforehand through a computer simulation so as to result in an optimal combination of film thicknesses.

Furthermore, the peak shift caused by an oxide layer present on the powder particle surface and the peak shift attributable to the wavelength dependence of refractive index are also taken in account. In the actual production of a sample, designed spectral curves and referred to and, in order to correct these in actual films, it is necessary to use a spectrophotometer or the like, while changing film thicknesses, to find optimal conditions under which reflection peaks or absorption bottoms appear at target wavelengths in a final target number of films. Also when a powder having irregular particle shapes is colored, interference occurs due to the multilayered film. A basic film design is hence made with reference to conditions for an interference multilayered film for spherical particles.

The peak position for each of unit coating films constituting the multilayered film can be regulated by changing the thickness of the layer, and the film thickness can be regulated by changing the solution composition, reaction time, and the number of starting-material addition times. Thus, the powder can be colored in a desired tint.

As described above, white and monochromatic powders can be obtained by finding optimal conditions under which reflection peaks or absorption bottoms appear at target wavelengths in a final target number of films, while changing film-forming conditions such as solutions for film formation. Furthermore, by controlling a combination of materials for forming a multilayered film and the thicknesses of the unit coating films, the color development by interference in the multilayered film can be regulated. Thus, a powder can be colored in a desired bright tint without a dye or pigment.

The medium to be used is desirably water or a nonaqueous solvent in the case of a magnetorheological fluid, and is desirably a nonaqueous solvent in the case of an electrorheological fluid and a magnetoelectrorheological fluid.

For applications such as dampers and actuators, any nonaqueous solvent may be used as long as it has a relatively high boiling point. On the other hand, for applications such as ink-jet inks and liquid toners, it is desirable to use an appropriate medium which is harmless to the human body and has a low boiling point.

Usually used media include hydrocarbons, such as alkylnaphthalenes, kerosine, liquid paraffin, dodecane, and the like; alcohols, such as butyl alcohol, higher alcohols (e.g., lauryl alcohol), polyhydric alcohols (e.g., ethylene glycol), propylene glycol, and the like; ketones, such as acetone oil and the like; ethers, such as ether, halophenyl ethers, and the like; chlorinated paraffins; alkyl bromides; aromatic carboxylic acids; esters, such as diethylene naphthalate, ethyl acetate, and the like; hydrocarbons, such as decane, dodecane, and the like; mixed oils, such as petroleum greases, mineral spirits, petroleum lubrication oils, transformer oils, and the like; fluorochemical oils; silicone oils, such as modified silicone oils including aminated and carboxylated ones, and the like; oligomers for polymers; and liquid crystals, such as nematic liquid crystals, and the like.

A surfactant is preferably incorporated beforehand into those media for facilitating the dispersion of multilayer-coated particles into the media. Various surfactants can be used for this purpose. Examples thereof include anionic surfactants (for example, unsaturated fatty acids, such as oleic acid, linoleic acid, linolenic acid, and the like, and alkali salts of these unsaturated fatty acids; carboxylic acids, such as alkyl ether acetic acids and the like, and salts of these acids; sulfonic acids and salts thereof; sulfuric and sulfurous ester salts; phosphoric esters and salts thereof; boron compounds; polymers obtained by polymerization; and polymers obtained by polycondensation); cationic sufactants (for example, aliphatic amines and ammonium salts thereof; aromatic amines and ammonium salts thereof; heterocyclic amines and ammonium salts thereof; polyalkylene polyamine type; and polymer type); nonionic sufactants (for example, ether type; ester-ether type; ester type; polysaccharides, such as dextrins and the like; polymers, such as hydroxyalkyl celluloses, other cellulose derivatives, and the like; modified silicone oils, such as carboxylated silicone oils, animated silicone oils, and the like; nitrogen-containing compounds); amphoteric surfactants (for example, betaine type and organic amino acid type); and reactive surfactants (for example, silane coupling agents and titanium coupling agents). The addition amount of such a surfactant is suitably determined.

Some of the carboxylated silicone oils and aminated silicone oils function as a surfactant, and others can directly react with substances present on the surface of a powder to disperse the particles. The addition amount of a powder and the amount of such a modified silicone oil are suitably determined according to the lipophilicity and surface area of the particles.

Those media may have been colored with a colorant, such as dye or the like. For example, by dispersing a white multilayer-coated powder into a medium containing a dye dissolved therein, a color ink for ink-jet printers can be obtained which has a bright color and actuates in response to an electric field.

Furthermore, when a fluid comprising a white solution containing a color powder dispersed therein is placed in a sealed partitioned container and the powder particles in each container cell are moved by means of an electric field so as to come into contact with a display surface, then the fluid can be used also as a color display medium.

In the present invention, the surface of the multilayer-coated powder to be dispersed into a medium is desirably treated beforehand so as to have an affinity for solvents. For example, multilayer-coated powder is dispersed with heating and stirring into a solvent (e.g., kerosine) containing a fatty acid (e.g., sodium oleate), whereby an effective surface treatment for imparting an affinity for solvents can be conducted. As a result, the multilayer-coated powder can be evenly dispersed into a medium.

There is an optimal combination among particles, dispersants, and solutions with respect to dispersibility and flowability. It is necessary to determine the optimal combination based on chemical anticipations or experiments.

An easily dispersed state in a solvent of a multilayer-coated powder particle which has been treated beforehand according to the present invention with a surfactant so as to have an affinity for solvents is shown in FIG. 2. In this case, the polar groups of the surfactant are located on the surface of the multilayer-coated particle, with the lipophilic parts of the surfactant being arranged outward. Consequently, the multilayered-coated powder is satisfactorily dispersed in the organic solvent, which is usually oleophilic.

BEST MODES FOR CARRYING OUT THE INVENTION

Figure 1:
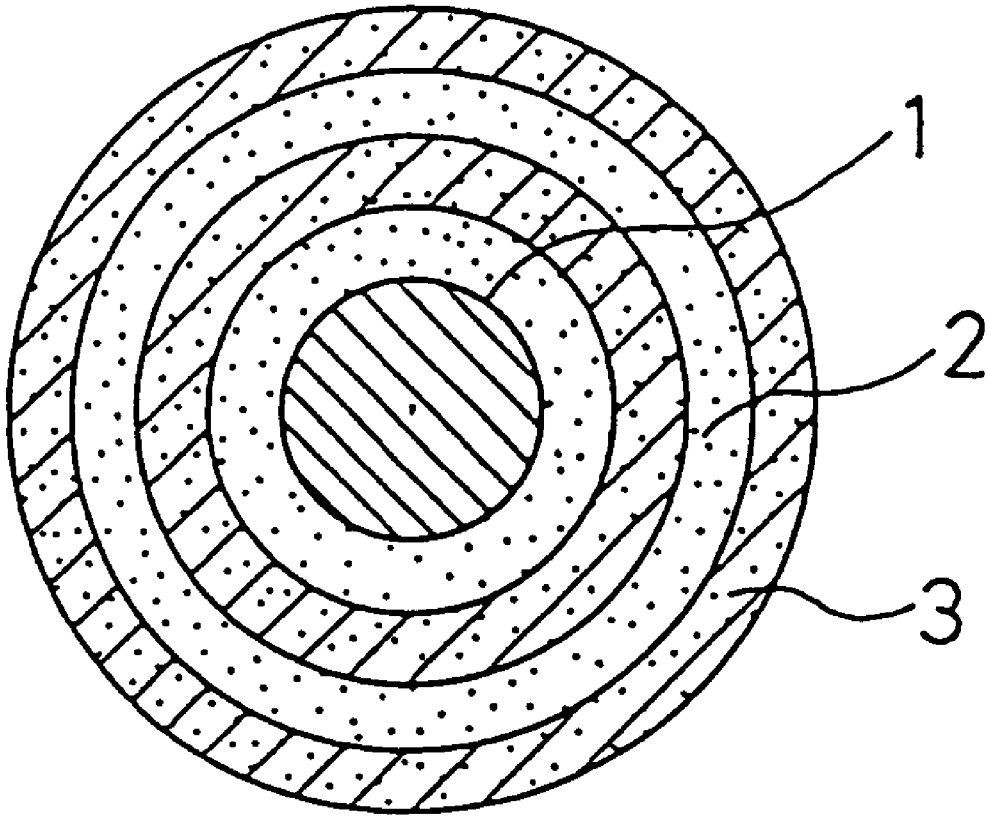
FIG. 1 is a sectional view diagrammatically illustrating the structure of a particle of a multilayer-coated powder for use in the electro-, magneto-, or magnetoelectrorheological fluid of the present invention; numeral 1 denotes a base powder particles; numeral 2 denotes a coating layer; and numeral 3 denotes a coating layer differing in refractive index from the coating layer 2.
Figure 2:
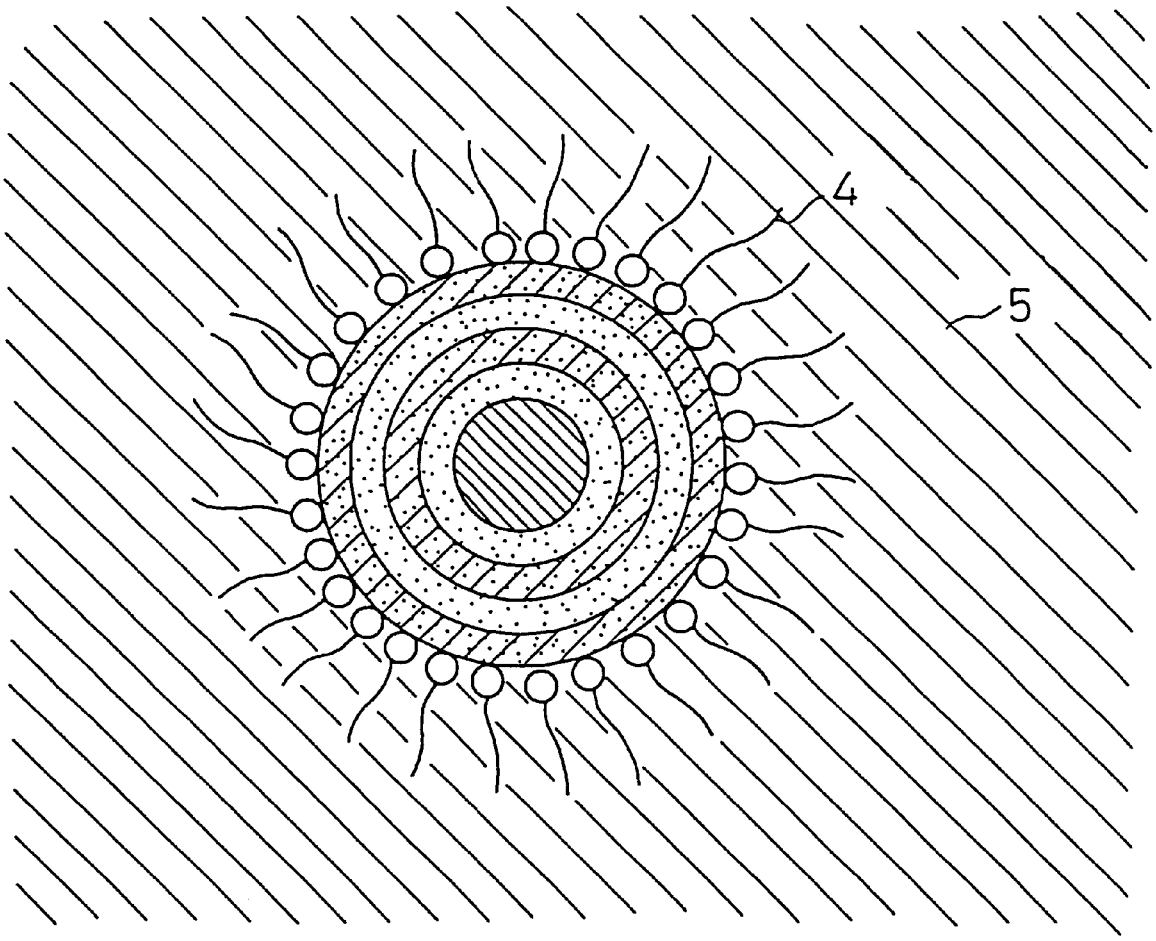
FIG. 2 illustrates an easily dispersed state in a solvent of a multilayer-coated powder particle which has been treated with a surfactant so as to have an affinity for solvents; numeral 4 denotes a surfactant molecule and 5 denotes the medium.

The present invention will be explained below in more detail by reference to Example. However, the invention should not be construed as being limited to these Examples only.

EXAMPLE 1

Into 130 g of a silver solution prepared beforehand were dispersed 50 g of polyethylene particles (average particle diameter, 10 $\mu$m). Thereto was added 130 g of a reducing solution to form a silver film. Thus, silver-coated polyethylene powder $A_1$ was obtained.

The silver solution and the resulting solution had been prepared in the following manners. In preparing the silver solution, 35 g of silver nitrate was dissolved in 600 g of deionized water. Thereto was added 45 g of ammonia, followed by an alkali solution consisting of 25 g of sodium hydroxide and 600 g of water. Ammonia was further added to the resultant mixture until the precipitated silver oxide changed into complex ions to make the mixture transparent. Thus, the silver solution was prepared. The reducing solution used was prepared by dissolving 45 g of glucose in 1 liter of deionized water, adding 4 g of tartaric acid thereto and dissolving the same, boiling the resultant solution for 5 minutes, cooling the solution to room temperature, adding 100 ml of ethanol thereto, and aging the resultant mixture for 1 week.

To 500 ml of deionized water were added 50 g of the silver-coated polyethylene powder $A_1$ and 100 g of styrene monomer. While this mixture was held at 55° C. with stirring, 3 g of sodium lauryl sulfate was added thereto to emulsify the monomer. Thereto was added 1 g of ammonium persulfate to initiate a polymerization reaction. The reaction mixture was continuously stirred for 5 hours and then filtered to take out the solid matter. Thus, polystyrene/silver-coated polyethylene powder $A_2$ was obtained.

To 50 g of the polystyrene/silver-coated polyethylene powder $A_2$ was added 130 g of the silver solution to disperse the powder. To this dispersion was added 130 g of the reducing solution to form a silver film. Thus, silver/polystyrene-coated polyethylene powder $A_3$ was obtained. The silver/polystyrene-coated polyethylene powder $A_3$ obtained was white and had a reflectance of 70%.

Table 1 shows the refractive index of the base particles, that of each film, and the thickness of each film in the powder $A_3$ obtained above.

TABLE 1

Refractive index of each film etc. and film thickness

| | Refractive index | Film thickness (nm) |
|---|---|---|
| Polyethylene base particles | 1.51 | |
| First layer, silver film | 0.05 + 2.87i | 24 |
| Second layer, polystyrene film | 1.59 | 94 |
| Third layer, silver film | 0.05 + 2.87i | 25 |

This powder $A_3$ was mixed with 500 ml of kerosine containing 35 g of sodium oleate. This mixture was stirred for 3 hours while dispersing the powder at a constant temperature of 90° C., subsequently cooled to room temperature, and then filtered to recover the solid matter.

This solid matter was dispersed in 50 ml of cyclohexane containing 7 g of Oil Red as a red dye. The resultant fluid was stirred to mix the ingredients and then applied to a white paper for copying in an amount of 0.05 ml/cm$^2$. As a result, the paper was colored in bright-red.

EXAMPLE 2

First layer: Silica coating

Into 100 ml of ethanol was dispersed 10 g of a carbonyl iron powder (average particle diameter, 1.8 $\mu$m) manufactured by BASF. The container was heated with an oil bath to keep the temperature of the liquid at 55° C. Thereto were added 6.5 g of silicon ethoxide and 6.5 g of ammonia water (concentration, 29%). This mixture was reacted for 4 hours with stirring so as to form a film having a thickness of 96 nm after drying and heating. After the reaction, the reaction mixture was diluted and washed with ethanol and filtered. The solid matter was dried in a vacuum dryer at 110° C. for 3 hours. After the drying, the resultant powder was heated with a rotary tabular oven at 650° C. for 30 minutes to obtain silica-coated powder $B_1$. The silica-coated powder $B_1$ obtained was excellent in dispersed state.

EXAMPLE 3

Production of Multilayer-coated Powder:

First layer: Silica coating:

Into 100 ml of ethanol was dispersed 10 g of a carbonyl iron powder (average particle diameter, 1.8 $\mu$m) manufactured by BASF. The container was heated with an oil bath to keep the temperature of the liquid at 55° C. Thereto were added 6.5 of silicon ethoxide and 6.5 g of ammonia water (concentration, 29%). This mixture was reacted for 4 hours with stirring so as to form a film having a thickness of 96 nm after drying and heating. After the reaction, the reaction mixture was diluted and washed with ethanol and filtered. The solid matter was dried in a vacuum dryer at 110° C. for 3 hours. After the drying, the resultant powder was heated with a rotary tabular oven at 650° C. for 30 minutes to obtain silica-coated powder $C_1$. The silica-coated powder $C_1$ obtained was excellent in dispersed state.

Second layer: Titania coating:

After the heating, 10 g of the silica-coated powder $C_1$ obtained was redispersed into 200 ml of ethanol. The container was heated with an oil bath to keep the temperature of the liquid at 55° C. Thereto was added 7.3 g of titanium ethoxide. This mixture was stirred. A solution prepared by mixing 30 ml of ethanol with 7.3 g of water was added dropwise to the above mixture over 60 minutes, and the resultant mixture was reacted for 4 hours so as to form a film having a thickness of 72 nm after drying and heating. After the reaction, the reaction mixture was diluted and washed with ethanol and filtered. The solid matter was dried in a vacuum dryer at 110° C. for 3 hours. After the drying, the resultant powder was heated with a rotary tubular oven at 650° C. for 30 minutes to obtain silica/titania-coated powder $C_2$. The silica/titania-coated powder $C_2$ obtained had satisfactory dispersibility and was composed of independent particles. This silica/titania-coated powder $C_2$ was bright-green. The green powder obtained was composed of spherical particles and had a magnetization of 170 emu/g in a magnetic field of 10 kOe.

With respect to each coating film of the above coated powder, the peak wavelength for a spectral reflection curve, the reflectance at the peak wavelength, and the refractive index and thickness of the coating film were measuredly the following methods.

(1) The spectral reflection curve was obtained by a method in which a spectrophotometer having an integrating sphere and manufacture by Nippon Bunko was used to examined light reflected by a powder sample packed in a glass holder. The examination was made in accordance with JIS Z8723 (1988).

(2) The refractive index and the film thickness were determined and evaluated by examining samples produced under different conditions and having large film thicknesses to obtain spectral reflection curves and comparing the examination results, for fitting, with curves obtained through instrumental calculation based on the interference equation.

Table 2 shows the refractive index and film thickness of each of the first and second layers, the peak wavelength for a spectral reflection curve of the coated powder, and the reflectance at the peak wavelength.

TABLE 2

Refractive index, film thickness, peak wavelength and reflectance (%) of each film, etc.

| Coating Layer | Refractive index | Film thickness (nm) | Peak wavelength (nm) | Reflectance (%) |
|---|---|---|---|---|
| First layer, silica film | 1.5 | 96 | — | — |
| Second layer, titania film | 2.1 | 72 | 555 | 41 |

EXAMPLE 4

Examination for Oxidation Resistance:

The powder coated with a silica layer alone and the powder coated with a silica layer and a titania layer which powders had been obtained in Examples 2 and 3, respectively, were analyzed with a differential thermal analyzer to examine their oxidation resistance.

The oxidation initiation temperature of each powder is shown in Table 3. The results show that the coated powders were stable up to 400° C., whereas the iron powder alone began to oxidize at a temperature below 150° C. It is hence expected that since the oxidation initiation temperatures of the coated powders are higher than the boiling points of all media usable in rheological fluids, these powders do no undergo deterioration by oxidation, in particular, deterioration in magnetic properties by iron metal oxidation, even when used as rheological fluids.

TABLE 3

Oxidation initiation temperatures of base iron powder and film-coated powders

| | Oxidation initiation temperature (° C.) |
|---|---|
| Base iron powder | 143 |
| Coating with a silica layer | 421 |
| Coating with a silica layer and a titania layer | 587 |

EXAMPLE 5

Measurement of Relative Permittivity:

The space between two electrode plates disposed respectively at the top and bottom of a hollow cylinder made of an acrylic plate was packed with each of the powder coated with a silica layer alone and the powder coated with a silica layer and a titania layer which powders had been obtained in Examples 2 and 3, respectively. The relative permittivity of each powder was measured in each of the cases where the spaces among the powder particles were filled with air and where those spaces were filled with ethylene glycol (relative permittivity, 40). As a result, the apparent relative permittivity increased to ten times.

This effect was attributable to an interaction between the iron metal particles, functioning as a conductor, and the film(s) and the ethylene glycol, both functioning as a dielectric. It is presumed that in ethylene glycol, the coated powder undergo enhanced dielectric polarization and exert and enhanced actuating force in the same electrostatic field.

TABLE 4

Relative permittivities of each coated powder in air and in ethylene glycol

| | Relative permittivity (in air) | Relative permittivity (in EG) |
|---|---|---|
| Coating with a silica layer | 6.6 | 73 |
| Coating with a silica layer and a titania layer | 7.4 | 75 |

EXAMPLE 6

Preparation of Rheological Fluid:

With 50 g of ethanol was mixed 35 g of the powder coated with a silica film and a titania film obtained in Example 3. Thereto was added, with stirring, a 1.7% ethanol solution of hydroxypropyl cellulose. To the resultant solution was added 50 g of ethylene glycol. This mixture was heated at 80° C. until almost all the ethanol vaporized off the thereby conduct solvent replacement with ethylene glycol.

The fluid obtained was a rheological fluid in which the particles were in a completely dispersed state. This rheological fluid had a solid concentration of 36% and a viscosity at 25° C. of 120 cSt. The magnetization of this fluid was measured with a VSM was 59.5 emu/g. In view of the fact that ordinary magnetic fluids having the same concentration having magnetizations of about from 25 to 30 emu/g, the rheological fluid was found to exert a highly powerful actuating force in response to a magnetic field.

EXAMPLE 7

Application to Shaft Sealing:

The rotary shaft of a motor which shaft had an inner tube fixed thereto having an outer diameter of 10 cm and a length of 1 m was provided at its end with a magnet 1 having a width of 1 cm and a thickness of 0.7 cm and having an N pole inside, in such a manner that the magnet 1 was in contact with an outer tube having an inner diameter of 10.5 cm, a width of 5 cm, and a thickness of 1 mm. A band of soft iron having a width of 0.5 cm and a thickness of 0.7 mm was further disposed so that it was in contact with the magnet 1. Furthermore, the shaft was provided with a magnet which had a width of 1 cm and a thickness of 0.7 cm and had an S pole inside, i.e., which had the pole arrangement opposite to that of the magnet 1 and had the same size as the magnet 1.

The space between the inner and outer tubes was filled beforehand with 130 ml of the same fluid as that prepared in Example 6. The center of rotation of the outer tube was similarly fixed to a pressure vessel.

A DC voltage (100 V) was simultaneously applied to the inner and outer tubes.

Thereafter, the pressure vessel was evacuated with a vacuum pump. However, the fluid did not flow out.

The motor was run at 60 rpm. However, the vacuum was maintained.

Furthermore, the pressure vessel was repeatedly moved in opposite directions perpendicular to the rotary shaft over 1.5 cm. However, the vacuum was maintained.

INDUSTRIAL APPLICABILITY

As described above, a fluid which actuates upon application of an electric field of a magnetic field or of both can be provided according to the present invention. When this fluid is used in a damper, an actuator, or the like, the operation of a device equipped with the damper or actuator of the like can be precisely controlled by suitable regulating the intensity and direction of an electric field and magnetic field externally applied to the fluid. When an electric field and a magnetic field are simultaneously applied in the same direction, a more powerful actuating force is obtained.

Furthermore, a color fluid composition usable as a color ink for ink-jet printers, a color display medium, and the like can be provided. Since the particles themselves present in the fluid have an unfadable color produced by an interference multilayer film, the colored fluid composition is effective, e.g., for documents required to be preserved over long. Moreover, when a powder coated and colored with, e.g., a white metal is dispersed into a solvent containing a dye dissolved therein, a color ink of a bright color can be obtained with actuates in response to an electric field.

What is claimed is:

1. A rheological fluid comprising a multilayer-coated powder comprising a base particle having thereon coating layers which differ from each other in refractive index dispersed in a rheological medium, wherein the powder is colored due to light interference among the coating layers.

2. The rheological fluid according to claim 1, wherein said multilayer-coated has an average particle diameter of 0.015 to 100 $\mu$m.

3. The rheological fluid according to claim 1, wherein the base particle of the powder is selected from a conductive material, a dielectric material, an insulating material, and a magnetic material.

4. The rheological fluid according to claim 1, wherein at least one of the coating layers is an inorganic metal compound layer.

5. The rheological fluid according to claim 1, wherein at least one of the coating layers is a metal layer or an alloy layer.

6. The rheological fluid according to claim 1, wherein at least one of the coating layers is an organic layer.

7. The rheological fluid according to claim 1, wherein the surface of the multilayer-coated powder has been treated beforehand so as to have an affinity for solvents.

8. The rheological fluid according to claim 1, wherein the medium has been colored with a colorant.

9. The rheological fluid according to claim 1, wherein the base particle is spherical.

10. The rheological fluid according to claim 1, wherein the light interference comprises Fresnel interference.

11. The rheological fluid according to claim 1, wherein the coating layers have interference reflection peaks or interference transmission bottoms at the same wavelength.

12. The rheological fluid according to claim 1, wherein the base particle is a magnetic and conductive material.

* * * * *

UNITED STATES PATENT AND TRADEMARK OFFICE

CERTIFICATE OF CORRECTION

PATENT NO. : 6,280,658 B1 
DATED : August 28, 2001
INVENTOR(S) : Takafumi Atarashi and Katsuto Nakatsuka It is certified that error appears in the above-identified patent and that said Letters Patent is hereby corrected as shown below:

Title page,
Item [73], under Assignees change "Nittesu Mining Co., Ltd." to
-- Nittetsu Mining Co., Ltd. -- and "Katsuto Natatsuka" to -- Katsuto Nakatsuka --.

Signed and Sealed this

Eleventh Day of June, 2002

*Attest:*

*Attesting Officer*

JAMES E. ROGAN
*Director of the United States Patent and Trademark Office*